US005912865A

United States Patent [19]

Ortega

[11] Patent Number: 5,912,865

[45] Date of Patent: Jun. 15, 1999

[54] WATCH CASE WITH POSITIONING MEANS

[75] Inventor: Oscar Ortega, Rancho Santa Fe, Calif.

[73] Assignee: U.S.A. Technologies Inc.

[21] Appl. No.: 09/175,130

[22] Filed: Oct. 19, 1998

[51] Int. Cl.[6] ..... G04B 37/00; A44C 5/00

[52] U.S. Cl. ..... 368/276; 368/281

[58] Field of Search ..... 368/88, 276, 281–282, 368/309

[56] References Cited

U.S. PATENT DOCUMENTS

| | | | |
|---|---|---|---|
| 2,226,138 | 12/1940 | Prestinari | 368/281 |
| 4,224,948 | 9/1980 | Cramer et al. | 128/690 |
| 4,825,872 | 5/1989 | Tan et al. | 128/633 |
| 4,867,557 | 9/1989 | Takatani et al. | 356/41 |
| 5,068,840 | 11/1991 | Buckner | 368/281 |

OTHER PUBLICATIONS

Skin Reflectance Pulse Oximetry; Mendleson Yocum Biomedical Instrumentation and Technology.

*Primary Examiner*—Vit Miska
*Attorney, Agent, or Firm*—Page Lohr Associates

[57] ABSTRACT

A watch case is arranged with a periphery having a lobe and a recess to cooperate with the human anatomy and ergonomics. A specially shaped watch case provides a means to couple a wristwatch to a wrist bone. The coupling provides mechanism to reduce movement of the watch about the wrist and to locate an optical probe with respect to a preferred region of tissue. In addition to the special shape of the watch case, an arrangement of watch bands and their attachment to watch cases advances the objectives of devices of the invention.

9 Claims, 7 Drawing Sheets

WATCH CASE WITH POSITIONING MEANS

BACKGROUND OF THE INVENTION

Field

The following invention disclosure is generally concerned with wearable electronic instruments and specifically concerned with watch type timepieces which incorporate a heart rate function and the fit of these devices on the human wrist.

A timepiece commonly known as a wrist watch is small in size and arranged to be affixed and worn about the human wrist. Some technically advanced timepieces incorporate mechanisms which allow one to monitor heart rate. Optical sensors probe the tissue of the wearer and may be used to detect the pulse and pulse rate. Thus, ones heart rate may be made available to the wearer via a numeric display on the face of the watch. Some examples of heart rate monitors which may be built into wristwatches include:

A reflection type oximeter taught by Takatani et al, in U.S. Pat. No. 4,867,557 uses changes in light pulses which are variably absorbed by blood oxygen.

Inventor Tan et al has combined a special apparatus which accommodates a finger therein and provides for optical probing of tissue via a light source and detector which are strongly coupled to tissue in U.S. Pat. No. 4,825,872.

Cramer et al teaches of a wrist borne pulse meter and chronometer in U.S. Pat. No. 4,224,948. The device combines a wristwatch and optical probing of tissue of the wrist to achieve a multi-functional device operable for displaying the wearer's heart rate.

Typically, a watch body or watch case is a few centimeters in width and has flat top and bottom portions. The case may have a thickness typically between 3 and 10 millimeters. It is generally constructed of rigid material such as molded plastics or composites. It may alternatively be made of metallic material having been molded or stamped. In most configurations, a watch case has a simple and symmetrically shaped periphery such as the circle illustrated in figure one of the disclosure.

A watch band may be connected to opposite sides of a watch body and may be used to affix the case to the wrist on its top or outer surface. The watch band is generally flexible and may be made from material such as cloth or plastic. Alternatively, watch bands may be made from durable metal material which has been formed into a chain of a plurality of link elements. A watch band portion attached at either side of a watch case forms means for affixing the watch about the wrist of a user. In this way, the timepiece may be worn as jewelry while simultaneously providing functionality.

A watch is preferably located on the top of the wrist as the arm is pronate. A watch worn about the wrist tends to naturally slide to the part of the wrist where the diameter is smallest. Since a watch band is typically wore with a bit of slack for comfort, the watch is meant to fit rather loosely about the wrist. Although the watch may tend to slide rotatably about the wrist, the watch case will stay on the top portion of the wrist unless the watch band is exceptionally loose. The watch is therefore located in a position which is easy to reference in a user's simple glance.

While exercising, and in particular in running sports, a watch may tend to move about the wrist in a manner which is undesirable. A runner's arms may be thrust alternately upward and downward in an effort to balance the motion of other body parts. This movement tends to cause a watch to become dislocated from its normal rest position and to move about the wrist in an oscillating fashion which may tend to annoy. Still further, the oscillating watch having a solid case of considerable mass may repeatedly hit or otherwise come into contact with the wrist bone in a manner which could cause pain. Of course, a natural response would be to tighten the watchband so that the watch fits tighter to the wrist and thus the motion of the watch case would be reduced. However, a tightened wrist band tends to reduce circulation and may otherwise be uncomfortable. Accordingly, runners and other athletes may elect to not wear a wristwatch during the practice of their athletics.

The problem of undesired movement during exercise is particularly troublesome to specialty devices which have been integrated with wristwatch type timepieces. For example, wristwatches configured to include devices which measure the wearer's heart rate. For example, consider U.S. Pat. No. 4,224,948 where Cramer et al, have devised a way for optical transducers on the bottom of a wristwatch to be coupled to the skin of the wearer. Although the device may work well when a user is sitting still, a watch which moves excessively tends to disturb the coupling of the transducers and the tissue being probed.

Indeed the inventor of the present invention was motivated by the device disclosed as U.S. Patent application having a Ser. No. 09/030,654, which also has a particular optical element which may suffer in performance when a watch is moved about the wrist excessively.

SUMMARY OF THE INVENTION

Comes now, Oscar Ortega with an invention of a watch case having a positioning means. It is a primary function of this watch type device to provide improved performance in consideration of heart rate monitoring functionality. It is a contrast to prior art methods and devices that present systems do not suffer from the bad effects of poor coupling of the device to the tissue. A fundamental difference between watches of the instant invention and those of the art can be found when considering its unique positioning means which is particularly configured to cooperate with the wrist bone.

Devices of the invention include a specially shaped watch case which may be coupled conformably and securely to the natural shape of the human wrist including the wrist bone. Such an ergonomically preferred shape tends to not only improve the function of the device but also improves the comfort which may be realized by the wearer of devices of the invention.

The invention thus stands in contrast to methods and devices known previously. The invention includes a watch case having a special ergonomic shape. This special shape is configured to cooperate with the natural shape of the human body and improve performance in view of physical attributes which are particular to devices which optically probe human tissue, the optical probe being combined with a wristwatch type timepiece.

OBJECTIVES OF THE INVENTION

It is a primary object of the invention to provide an improved watch case.

It is an object of the invention to provide a watch case which allows for a high performance timepiece having a pulse meter integrated therewith.

A better understanding can be had with reference to the detailed description of Preferred Embodiments and with reference to the appended drawings. These embodiments represent particular ways to realize the invention and are not inclusive of all ways possible. Therefore, there may exist embodiments that do not deviate from the spirit and scope of this disclosure as set forth by the claims, but do not appear here as specific examples. It will be appreciated that a great plurality of alternative versions are possible.

BRIEF DESCRIPTION OF THE DRAWING FIGURES

These and other features, aspects, and advantages of the present invention will become better understood with regard to the following description, appended claims and drawings where:

Figure 4:
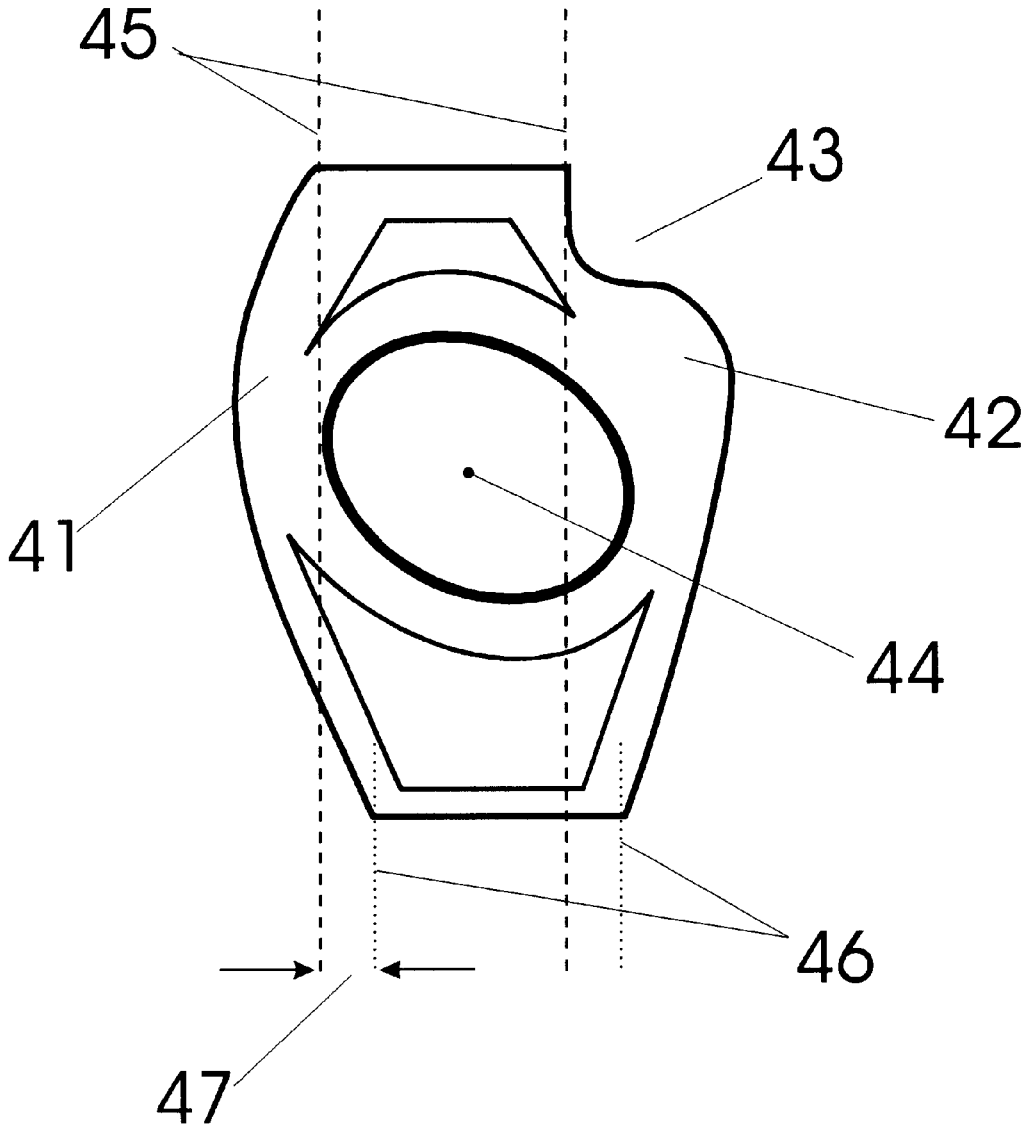
Figure 5:
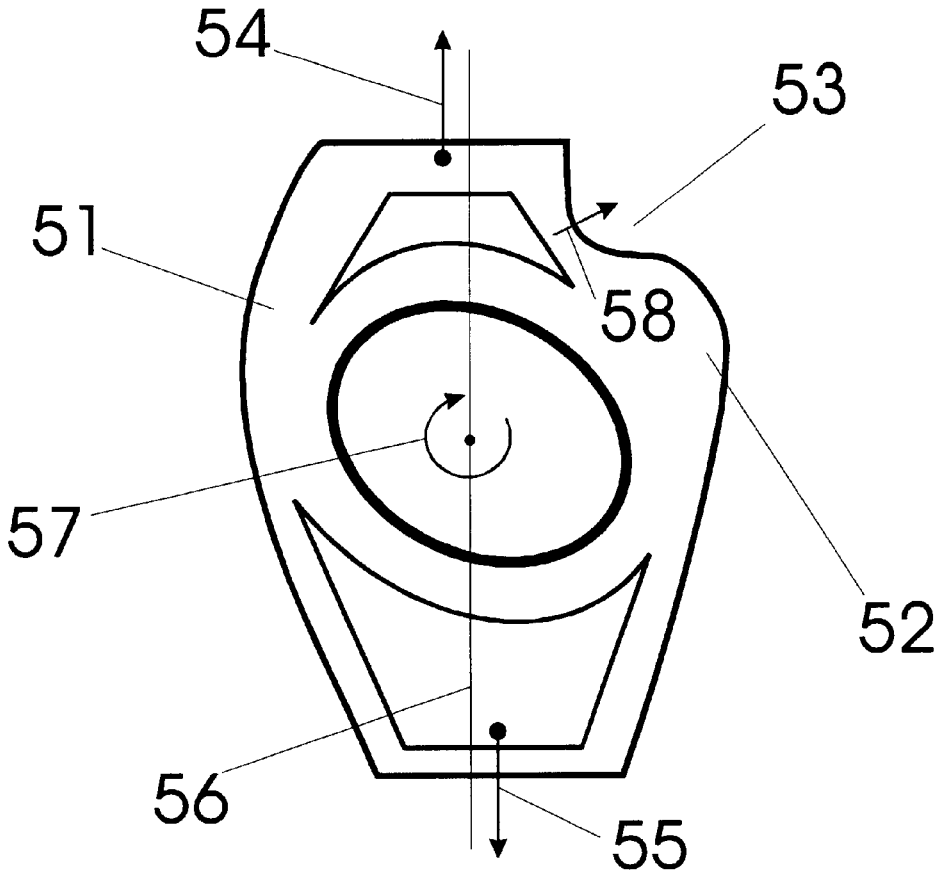
Figure 6:
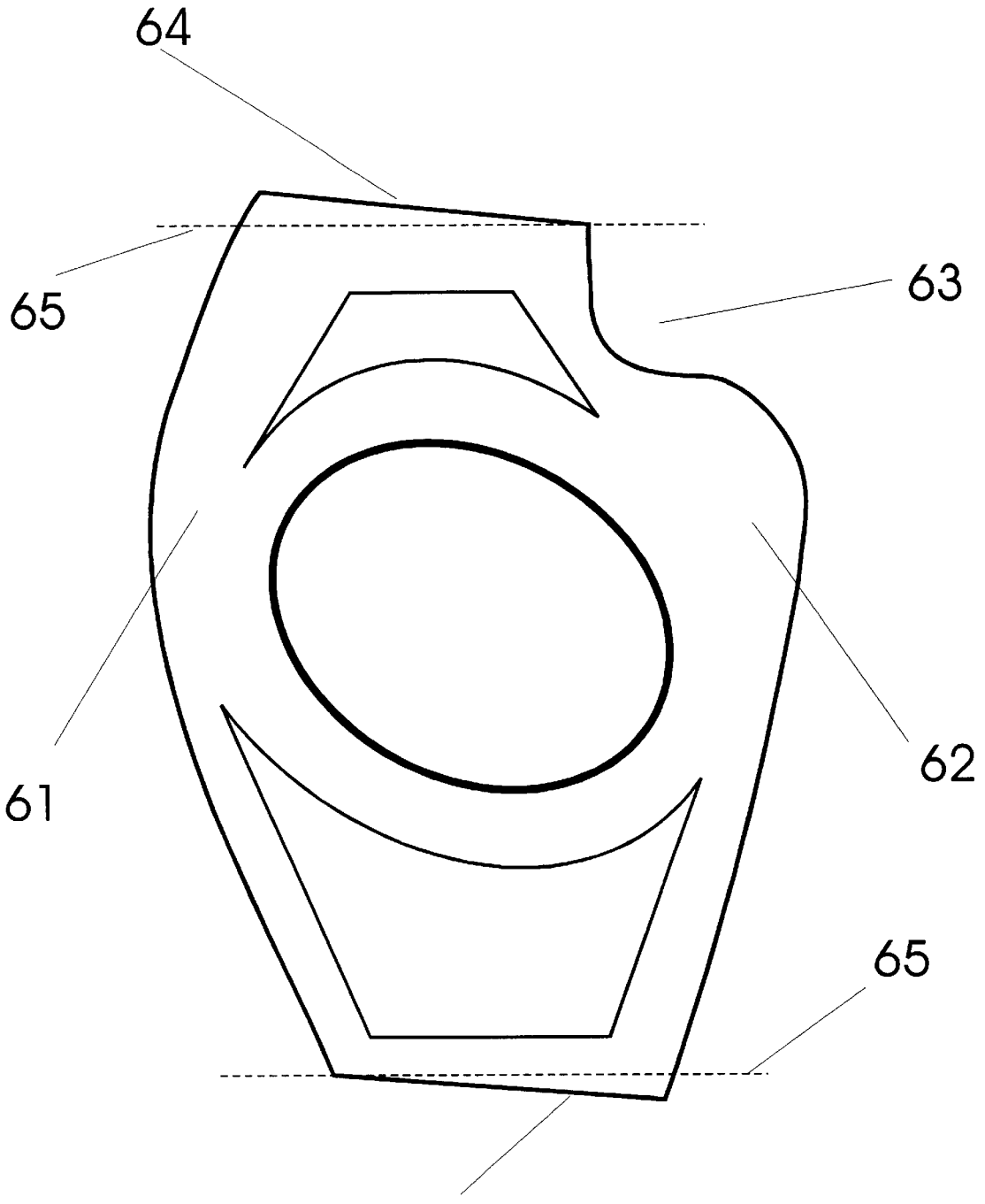
Figure 7:
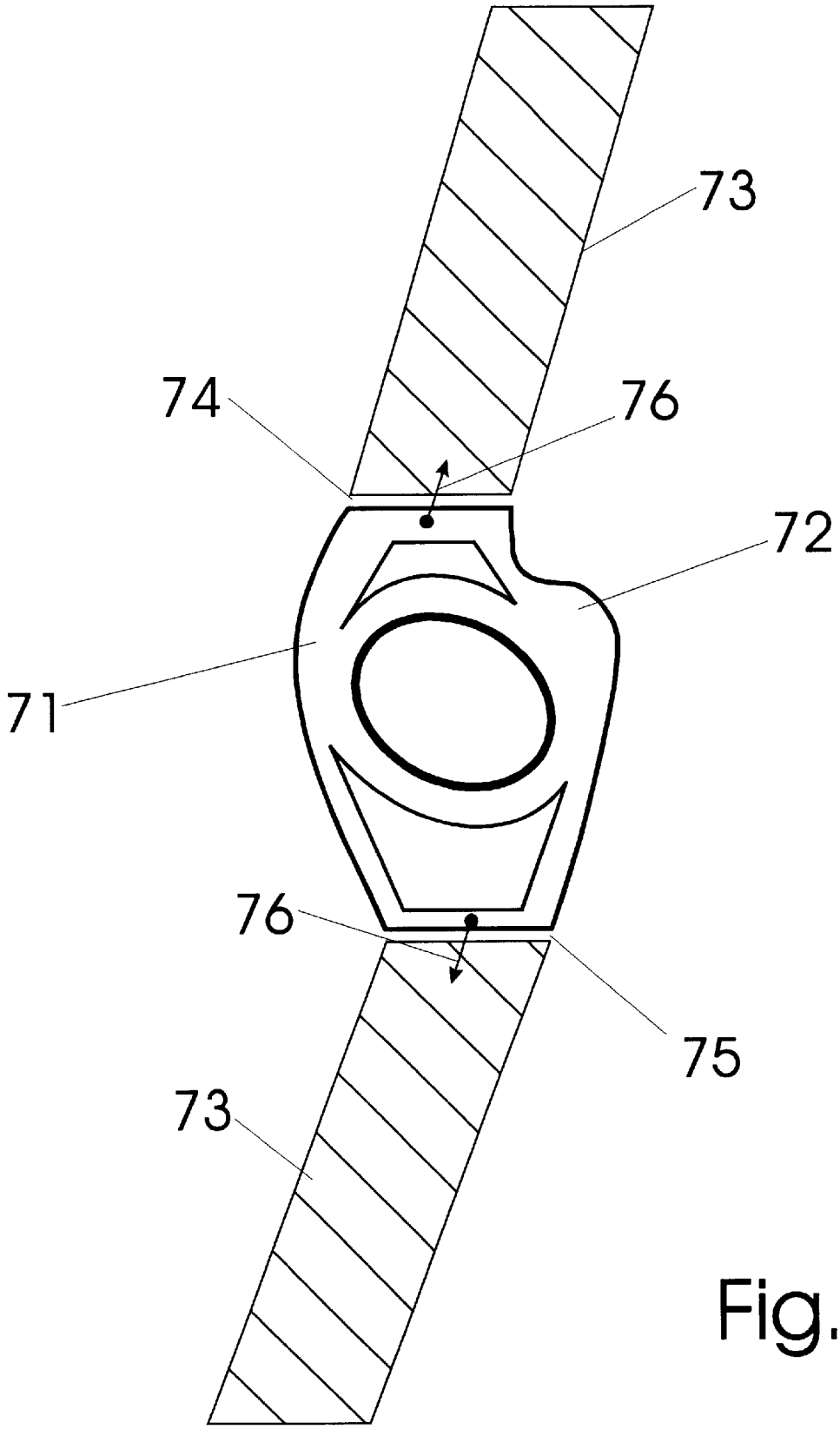

FIG. 4 describes some important geometric properties of a device of the invention;

FIG. 5 similarly shows important geometric principles relating to the operation of devices of the invention;

FIG. 6 is a highly magnified view which allows one to further appreciate a subtle aspect of the geometries which may be used in devices of the invention;

FIG. 7 shows a device of the invention as it may be coupled to a specially configured supporting wrist band.

PREFERRED EMBODIMENTS OF THE INVENTION

In accordance with each of the preferred embodiments of the invention, there is provided apparatus including watch cases having a positioning means. It will be appreciated that each of the embodiments described include both an apparatus and that the apparatus of one preferred embodiment may be different than the apparatus of another embodiment.

Throughout this disclosure, reference is made to some terms which may or may not be exactly defined in popular dictionaries as they are defined here. To provide a more precise disclosure, the following terms are presented with a view to clarity so that the true breadth and scope may be more readily appreciated. Although every attempt is made to be precise and thorough, it is a necessary condition that not all meanings associated with each term can be completely set forth. Accordingly, each term is intended to also include its common meaning which may be derived from general usage within the pertinent arts or by dictionary meaning. For purposes of this disclosure:

timepiece refers to an instrument which may be arranged to measure time and related functions including those which might relate to periodic events;

wristwatch is a timepiece which may be worn about the wrist and includes at least a watch case and a watch band, the watch case and watch band being affixed to one another;

pulse rate or heart rate are synonyms which are sometimes used in conjunction with apparatus terms to indicate devices operable for detecting, measuring and displaying information relating to the heart rate of a user of the device;

watch case is the element of a wristwatch which consists of the body portion and may contain electrical and mechanical works therein. Further, it may include support for the fastening of a watch band in one or more sites.

wrist band is the element of a wristwatch which consists of the fastening means operable for holding the watch case to the wrist.

In addition to the terms described above, for purposes of this disclosure use of the noun: "positioning means" which is functional in nature may be more readily appreciated in view of the following note:

positioning means

A positioning means is arranged to locate devices of the invention with respect to certain parts of the human anatomy. In many preferred embodiments of the invention, the positioning means is a specially shaped watch case periphery which operates to couple the device to the human body. The positioning means therefore locates the device.

Throughout this disclosure including the claims, certain clauses are used which relate to functional matters. For example, 'means for' or 'step for' followed by a phrase describing a function. One should remain mindful that any particular means which may be later provided as an example is not meant to limit the means for to that example but rather the example is provided to further illustrate certain preferred possibilities. Thus the 'means for' or 'step for' should not be limited to any particular structure which may be called out but rather to any conceivable means of causing the function described to be affected. The reader will recognize it is the function to be carried out which is the essence of the invention and many alternative means for causing the function to occur may exist without detracting from the combination.

Figure 1:
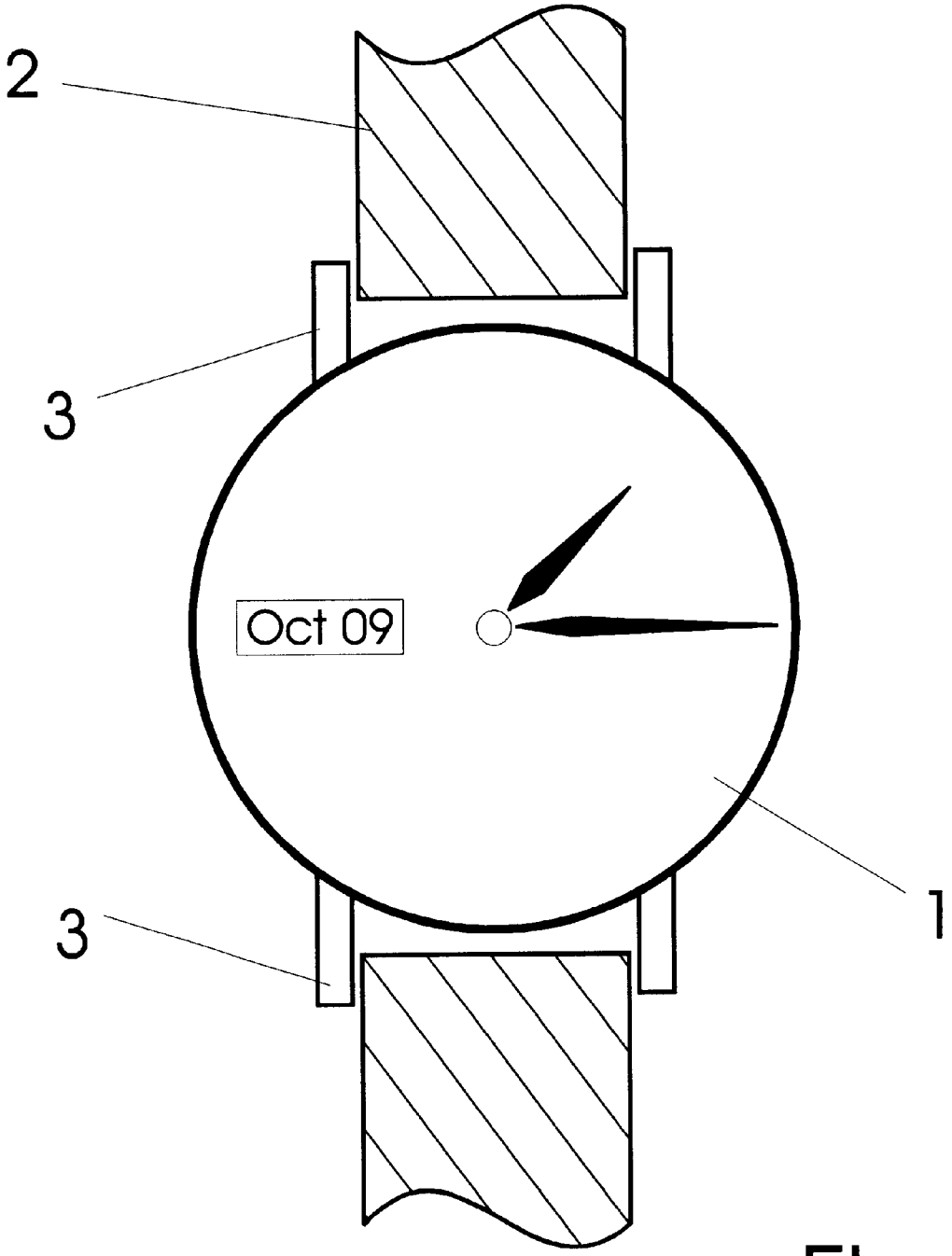
Fig. 1 (Prior Art)
FIG. 1 is a drawing showing a prior art device having a simply shaped watch case.

With reference to drawing FIG. 1, where a wristwatch type timepiece is illustrated in a simple line drawing, a watch body or watch case 1 may be combined with a watch band 2 which is fastened to the watch case on either side by fastening elements 3. The periphery of the watch case is shown as a simple circular shape which is common. Alternative shapes are available for their design and aesthetic value. Styling motivates watch designers to adopt various themes and trends which may be more or less attractive to consumers who purchase these devices. Some designs are sleek and elegant and complement fancy jewelry, while others may be sporty and include functionality such as a dive watch which may incorporate a moving bezel and indicia to indicate an elapsed time such as a bottom time. One will readily appreciate that the shape of the watch case periphery is not generally of any great importance and therefore may be arranged into various shapes purely for aesthetic purposes.

Figure 2:
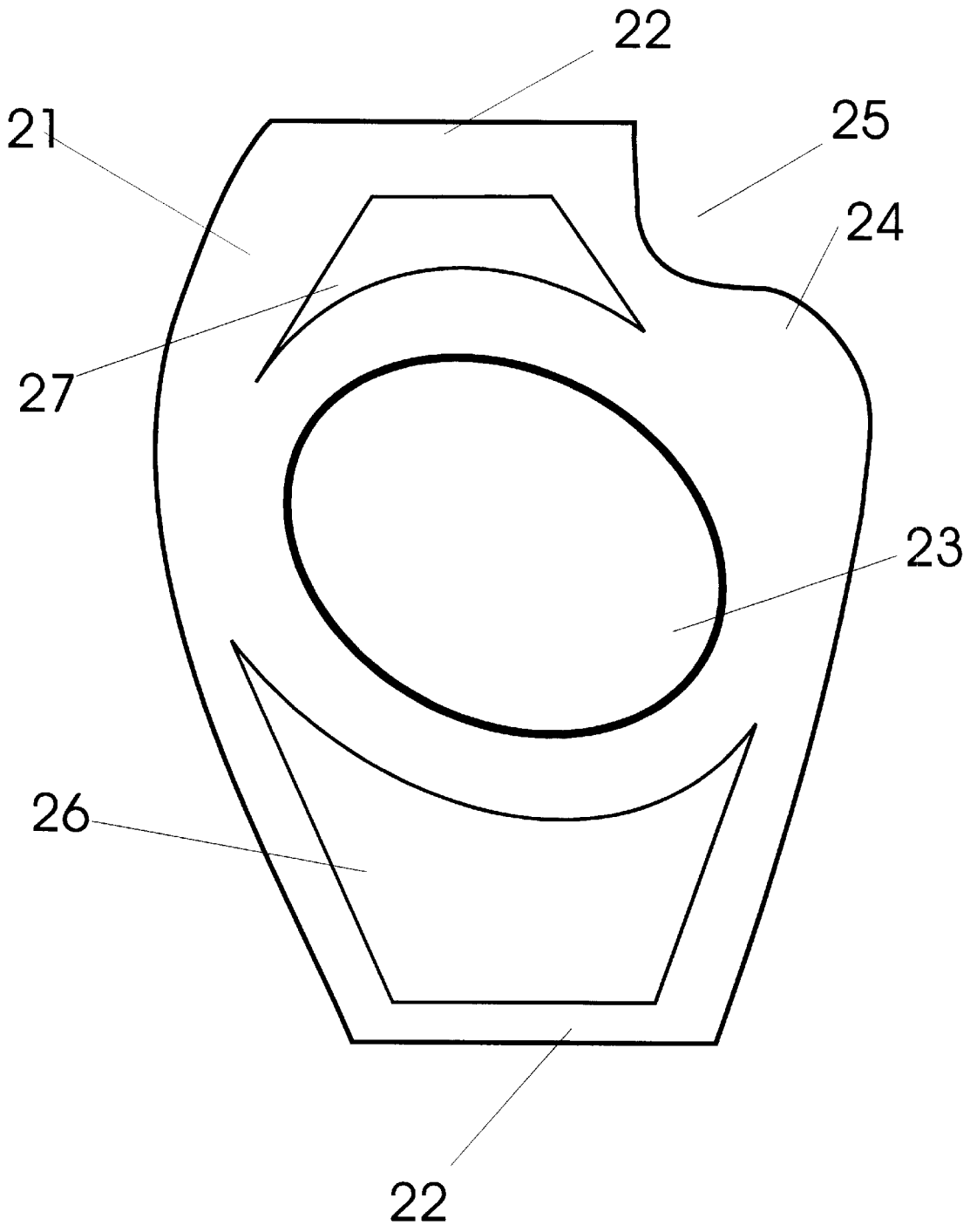
FIG. 2 illustrates a specially shaped watch case of the present invention.

FIG. 2 shows a special watch case 21 of the invention having a periphery of complex shape. The periphery may include sites 22 for attaching a common watch band in a conventional way. Further, region indicated as 23 may include display components such as liquid crystal display elements and other support for indicating time and related data. A special lobe 24 and recess 25 in the upper right hand portion of the watch case forms coupling with ergonomic considerations. Regions 26 and 27 may be arranged to accommodate control elements such as buttons or alternative input and output devices or attractive indicia for styling and function.

Figure 3:
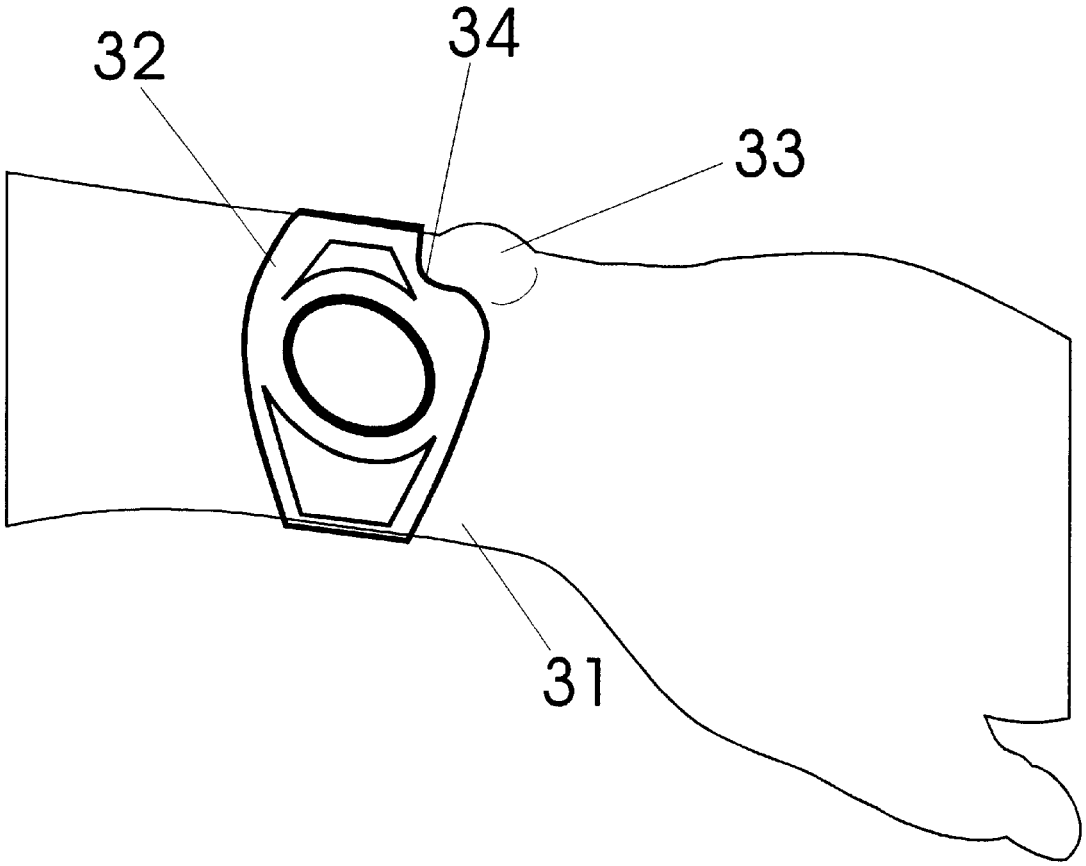
FIG. 3 shows a device of the invention coupled to a human wrist.

FIG. 3 shows how a watch case of the invention may be fitted to a human arm 31. The watch case 32 in combination with a watch band when wrapped about the wrist forms a closed loop arrangement which secures the watch to the arm. Because the fist and forearm are larger in size than the wrist, the watch stays located at the wrist at its narrowest point. The healthy human arm includes a wrist bone 33 which is located as shown in the drawing. When a watch is worn about the wrist, the watch may come into slight contact with the wrist bone. However, devices of the invention account for interaction between a wristwatch and the wrist bone. Indeed, the wrist bone is used in conjunction with a specially shaped watch case to cause the watch to be accurately positioned and held to the wrist in a manner which improves the functionality of the device. The lobe and recess combination 34 strongly couples the watch case to the wrist bone to reduce or eliminate movement of the watch about the wrist.

A wristwatch that is strongly coupled to the wrist bone serves as an improved platform from which a heart rate monitor may be incorporated. As an optical probe necessarily relies on a transducer being in strong contact with tissue, optical devices incorporated into wristwatches suffer from movement of the watch piece. Movement tends to reduce the efficacy of the optical probe. In some cases, for example in devices taught in U.S. patent application Ser. No. 09/030,654, an optical probe is preferably coupled to the anterior interosseous artery where a strong optical signal relating to pulse can be obtained. If an optical probe is disturbed by movement, then the signal on which the device relies is weakened and the device operability is compromised. Accordingly, the arrangement described above not only helps reduce movement of the watch and the optical probe, but also helps to properly locate the optical probe with respect to the region, i.e. the anterior interosseous artery, of greatest interest.

Special versions of devices of the invention include means to further enhance and improve the coupling of the watch case to the wrist bone. In consideration of certain geometries which may be used to attach a watch band to a watch case, one will appreciate a further improvement. The watch band geometries improvement cooperates with the lobe and recess configuration of the watch case. If an offset between two watch band fastening sites is arranged in a particular manner, an effect is produced which causes the lobe and recess combination to become more strongly coupled to the wrist bone. FIGS. 4 and 5 clearly illustrate this effect.

FIG. 4 shows a watch case 41 with a specially shaped periphery having a lobe 42 and recess 43. The geometric point 44 represents a center of mass. A first site to which a watchband portion may be affixed has extent limits indicated by dotted lines 45. A second site to which a complementary watch band portion may be affixed has extent limits indicated by dotted lines 46. Under close inspection, one will appreciate an offset 47 between the sites with respect to each other. In particular, the sites are displaced laterally such that one site is slightly left of the other in a vertical projection. Watchband portions affixed to sites arranged as shown will put a pulling force on the watch case which acts at the center of the sites and in a direction perpendicular to the site edge. The careful observer will note that due to the offset, the combined forces will act to cause the watch case to also have a slight rotational force.

FIG. 5 illustrates this further. Watch case 51 has complex shape including a lobe 52 and a recess 53. Force vectors 54 and 55 show how watch band portions arranged with an offset act upon the watch case. Each force vector being slightly offset with respect to the centerline 56, has a component which acts to produce a rotational force 57. This force tends to drive the watch case in the direction shown as 58. Thus the watch case is pushed into the wrist bone in a direction to further advance its coupling thereto. Therefore not only the geometry and shape of watch cases of the invention tends to cooperate with the wrist bone, but the arrangement of the watch band fastening sites also supports coupling a watch case to a wrist bone.

A similar effect can be realized in view of the geometric arrangement illustrated in FIG. 6. Watch case 61 having a lobe 62 and recess 63 may have watch band fastening sites 64 with edges aligned at a slight angle with respect to a horizontal projection line indicated in the drawing as dotted lines 65. A watch band attached to sites arranged as described will produce a pulling force with a small component acting to rotate the watch case.

FIG. 7 illustrates watch band portions which may be attached to the sites shown in FIG. 6. Watch case 71 having a lobe 72 may be accompanied by watch band portions 73 affixed to watch band sites 74 and 75 to produce pulling forces 76. A watch case arranged in this way will be better coupled to a wrist bone.

One will now fully appreciate how a watch case may be arranged to include a positioning means. In particular, a positioning means which tends to couple the watch case to a wrist bone and thus reduce its movement about the wrist to which it may be fastened. Although the present invention has been described in considerable detail with clear and concise language and with reference to certain preferred versions thereof including the best mode anticipated by the inventor, other versions are possible. Therefore, the spirit and scope of the invention should not be limited by the description of the preferred versions contained therein, but rather by the claims appended hereto.

I claim:

1. A wristwatch having structure operable for coupling the watch case to a wrist bone, the wristwatch comprising:

a watch case having substantially flat top and bottom portions, a width from about one to four centimeters, and a periphery having a lobe and recess operable for engaging the wrist bone of a person wearing said wristwatch.

2. A wristwatch of claim 1, said lobe and recess are formed into the periphery at the top left portion of the watch case as the watch case oriented with respect to human wrist.

3. A wristwatch of claim 2, further comprising regions for output and input controls integrated with the top portion of the watch case.

4. A wristwatch of claim 2, further comprising a display region which supports liquid crystal type display elements.

5. A wristwatch of claim 1, said periphery forming two sites operable for receiving therein and having affixed thereto watch band portions, said sites having extent limits which form an offset with respect to each other.

6. A wristwatch of claim 1, said periphery forming two sites operable for receiving therein and having affixed thereto watch band portions, said sites having edges aligned askew with respect to a horizontal projection.

7. A wristwatch of claim 1, further comprising:

a watch band in two portions a first portion affixed to said watch case at a first site operable for receiving the first watch band portion and a second portion affixed to said watch case at a second site operable for receiving the second watch band portion.

8. A wristwatch of claim 5, further comprising:

a watch band in two portions a first portion affixed to said watch case at a first site operable for receiving the first watch band portion and a second portion affixed to said watch case at a second site operable for receiving the second watch band portion.

9. A wristwatch of claim 6, further comprising:

a watch band in two portions a first portion affixed to said watch case at a first site operable for receiving the first watch band portion and a second portion affixed to said watch case at a second site operable for receiving the second watch band portion.

* * * * *